US007887107B2

(12) United States Patent
Shen

(10) Patent No.: US 7,887,107 B2
(45) Date of Patent: Feb. 15, 2011

(54) UNIVERSAL ASSEMBLY FOR TOP AND BOTTOM LATCHES

(75) Inventor: Chun-Meng Shen, Sinying (TW)

(73) Assignee: I-Tek Metal Mfg. Co., Ltd., Annan (TW)

( * ) Notice: Subject to any disclaimer, the term of this patent is extended or adjusted under 35 U.S.C. 154(b) by 535 days.

(21) Appl. No.: 12/023,183

(22) Filed: Jan. 31, 2008

(65) Prior Publication Data

US 2009/0194999 A1 Aug. 6, 2009

(51) Int. Cl.
*E05B 65/10* (2006.01)
*E05B 65/00* (2006.01)

(52) U.S. Cl. ..... 292/92; 292/93; 292/94

(58) Field of Classification Search ..... 292/92–94
See application file for complete search history.

(56) References Cited

U.S. PATENT DOCUMENTS

| | | | | |
|---|---|---|---|---|
| 4,741,563 | A | 5/1988 | Cohrs | 292/21 |
| 4,961,330 | A | 10/1990 | Evans | 292/21 |
| 4,974,890 | A | 12/1990 | Cohrs | 292/363.3 |
| 5,702,134 | A * | 12/1997 | Hsieh | 292/92 |
| 6,641,183 | B2 * | 11/2003 | Brown | 292/92 |
| 6,820,905 | B1 * | 11/2004 | Haeck et al. | 292/93 |
| 7,144,050 | B2 * | 12/2006 | Lin | 292/93 |
| 7,287,784 | B2 * | 10/2007 | Lin | 292/92 |
| 7,748,757 | B2 * | 7/2010 | Shen | 292/92 |
| 2004/0227352 | A1 * | 11/2004 | Lin | 292/92 |

* cited by examiner

*Primary Examiner*—Carlos Lugo
(74) *Attorney, Agent, or Firm*—Alan Kamrath; Kamrath & Associates PA

(57) ABSTRACT

A latch assembly includes a base mounted to a door and a latch bolt having a latch pivotably connected to the base. The latch bolt further includes a link pivotably connected to the latch and the base. A follower plate is pivotably connected to the link, allowing pivotal movement of the follower plate and the link relative to the base and allowing relative pivotal movement between the follower plate and the link. A linking rod is coupled with the follower plate to move therewith. When the linking rod moves in a vertical direction, the follower plate moves together with the linking rod to pivot the latch between a latching position and an unlatching position. The latch assembly can be utilized as a surfaced-type or concealed-type bottom latch. After adding some parts, the latch assembly can be converted into a surfaced-type or concealed-type top latch.

5 Claims, 11 Drawing Sheets

UNIVERSAL ASSEMBLY FOR TOP AND BOTTOM LATCHES

BACKGROUND OF THE INVENTION

The present invention relates to a universal assembly and, more particularly, to a universal assembly for top and bottom latches for a panic exit door or the like.

Panic exit doors include horizontal type latches and vertical type latches. Vertical type latches include a top latch and a bottom latch, wherein the top and bottom latches include concealed type and surfaced type according to the way they are mounted. Conventionally, concealed-type top and bottom latches are different from one another and different from surfaced-type top and bottom latches that are also different from one another. U.S. Pat. No. 4,974,890 to Cohrs discloses a universal assembly including components and parts interchangeable between, for being common to, a top latch and a bottom latch in vertical-rod exit devices. Simply by adding a few discrete parts to the assembly, the same becomes, selectively, a top latch or a bottom latch. However, the resultant top and bottom latches are still too complicated and have too many different parts, leading to increased costs and assembling inconvenience.

A need exists for a universal assembly for top and bottom latches that have more common parts and less different parts.

BRIEF SUMMARY OF THE INVENTION

The present invention solves this need and other problems in the field of universal assemblies for top and bottom latches by providing, in a preferred form, a latch assembly includes a base adapted to be mounted to a door. A latch bolt includes a latch having a first end pivotably connected to the base and a second end. The latch bolt further includes a link having a first end pivotably connected to the latch. The link further includes a second end pivotably connected to the base. The second end of the latch is pivotable between a latching position outside the base and an unlatching position inside the base. A follower plate is movably received in the base in a vertical direction. The follower plate includes a first end and a second end. The first end of the follower plate is pivotably connected to the second end of the link, allowing pivotal movement of the follower plate and the link relative to the base and allowing relative pivotal movement between the follower plate and the link. A linking rod includes a first end coupled with the second end of the follower plate to move therewith. The linking rod further includes a second end adapted to be connected to a vertical rod of a panic device mounted to the door to move therewith. When the linking rod moves in the vertical direction, the follower plate moves together with the linking rod in the vertical direction to pivot the latch between the latching position and the unlatching position.

In the most preferred form, the latch includes a first pivotal portion on the first end thereof and a second pivotal portion between the first and second ends thereof. A first pin extends through the base and the first pivotal portion of the latch and defines a first pivot axis about which the second end of the latch pivots. A second pin extends through the first end of the link and the second pivotal portion of the latch and defines a second pivot axis parallel to the first pivot axis. The base is substantially U-shaped and including a main section and two sidewalls interconnected by the main section. The follower plate and the latch bolt are movably received between the sidewalls of the base. The first pin extends through the two sidewalls of the base. The sidewalls of the base include aligned first sliding slots extending in the vertical direction. A pin slideably extends through the first sliding slots in the vertical direction. The third pin further extends through the first end of the follower plate and the second end of the link, allowing pivotal movement of the follower plate and the link relative to the base and allowing relative pivotal movement between the follower plate and the link. The third pin is parallel to the first and second pins. The third pin moves in the first sliding slots in the vertical direction when the linking rod moves in the vertical direction to move the second end of the latch between the latching position and the unlatching position. The sidewalls of the base further include aligned second sliding slots extending in the vertical direction and above the first sliding slots. A fourth pin extends through the second sliding slots, the follower plate, and the first end of the linking rod, allowing joint vertical movement of the linking rod, the follower plate, and the fourth pin. The follower plate is substantially U-shaped and includes two sidewalls and an intermediate section interconnecting the sidewalls of the follower plate. The sidewalls of the follower plate include aligned slots extending in the vertical direction. The fourth pin slideably extends through the slots of the sidewalls of the follower plate. The third pin extends through the sidewalls of the follower plate and below the fourth pin. The second end of the link is received between the two sidewalls of the follower plate. A first spring is attached between the intermediate section of the follower plate and the main section of the base. The first spring is compressed when the second end of the latch is in the unlatching position, and with the compressed first spring biases the second end of the latch to the latching position.

The above-mentioned latch assembly can be utilized as a surfaced-type bottom latch or a concealed-type bottom latch of a panic device. After some modification, the above-mentioned latch assembly can be converted into a surfaced-type top latch or a concealed-type top latch after adding some parts. Particularly, the sidewalls of the base further include aligned first guiding slots each between one of the first sliding slots and one of the second sliding slots. Each first guiding slot includes a vertical section extending in the vertical direction and an inclined section at an acute angle with the vertical section. The sidewalls of the base further include aligned second guiding slots each between one of the first sliding slots and one of the first guiding slots in the vertical direction. Each second guiding slot extends in a horizontal direction perpendicular to the vertical direction. The sidewalls of the follower plate further include aligned slots each between the third pin and the slot of one of the sidewalls of the follower plate. The follower plate further includes aligned first engaging notches. Furthermore, a positioning pin slideably extends through the second guiding slots of the base. A safety plate includes a second engaging notch. The fourth pin extends through the safety plate to pivotably connect the safety plate to the first end of the first end of the linking rod while allowing joint movement of the linking rod and the safety plate in the vertical direction. A fifth pin extends through the first guiding slots of the base, the inclined slots of the follower plate, and the safety plate. The fifth pin is parallel to the fourth pin. The safety plate pivots about a pivot axis defined by the fourth pin while the fifth pin is moving in the inclined slots of the follower plate and the first guiding slots of the base. A second spring is attached between the positioning pin and the safety plate for biasing the safety plate toward the positioning pin. When the second end of the latch is in the latching position, the positioning pin is engaged with the second engaging notch of the safety plate to retain the latch in place. When the second end of the latch is in the unlatching position, the positioning pin is engaged with the first engaging notches of the follower plate to retain the latch in place. A guard plate is pivotably mounted to the base between the two sidewalls of the base and includes a first end and a second end. The first end of the guard plate is adapted to be pressed against by a strike mounted to a door frame of the door when the door is being closed. The second end of the guard plate comes in contact with and urges the positioning pin to disengage from the first engaging notches of the follower plate to release the latch when the first end of the guard plate is pressed against by the strike. Thus, second end of the latch moves to the latching position by the first spring.

In a case of a surfaced-type top latch, the first pin extends through the guard plate to pivotably connect the guard plate to the base and the first pivotal portion of the latch. In another case of a concealed-type top latch, the third pin extends through the first sliding slots of the base, the second end of the link, and the guard plate.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
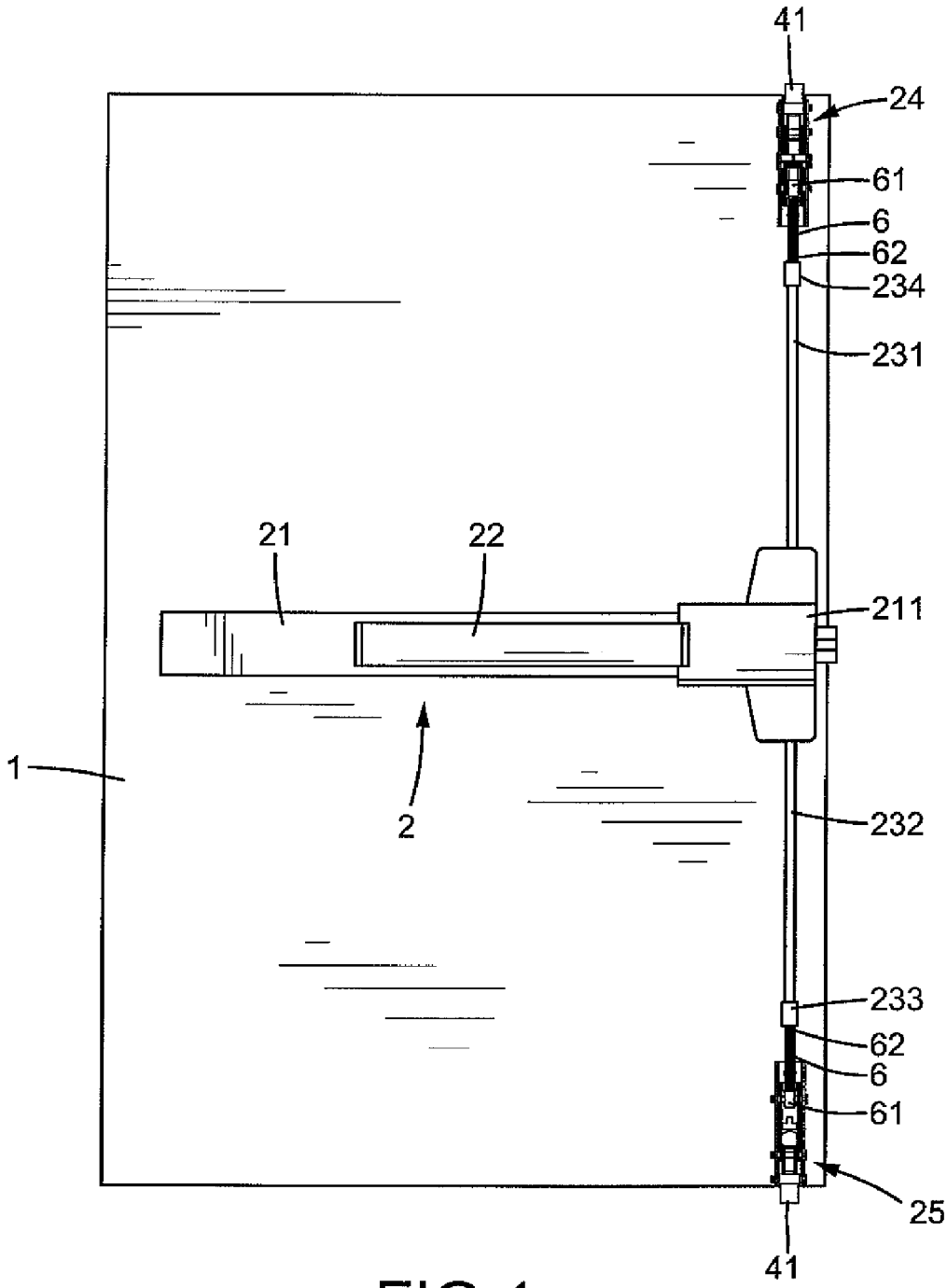
FIG. 1 shows a diagrammatic side view of a panic device mounted to a panic exit door according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "end", "portion", "section", "longitudinal", "horizontal", "vertical", "inward", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIG. 1 shows a panic device 2 mounted to a panic exit door 1 or the like and includes a housing 21 mounted to the door 1, a touch bar 22 mounted outside the housing 21 for manual operation, and a transmission mechanism (not shown) mounted in an end 211 of the housing 21. The panic device 2 further includes a top latch 24 and an upper vertical rod 231 having a lower end coupled with the transmission mechanism and an upper end 234 coupled with the top latch 24. The panic device 2 further includes a bottom latch 25 and a lower vertical rod 232 having an upper end coupled with the transmission mechanism and a lower end 233 coupled with the bottom latch 25. When the touch bar 22 is pressed, the upper and lower vertical rods 231 and 232 are moved toward each other in a vertical direction to unlatch the top and bottom latches 24 and 25. The transmission mechanism can be of any desired form as conventional including but not limited to of a commercially available type.

Figure 2:
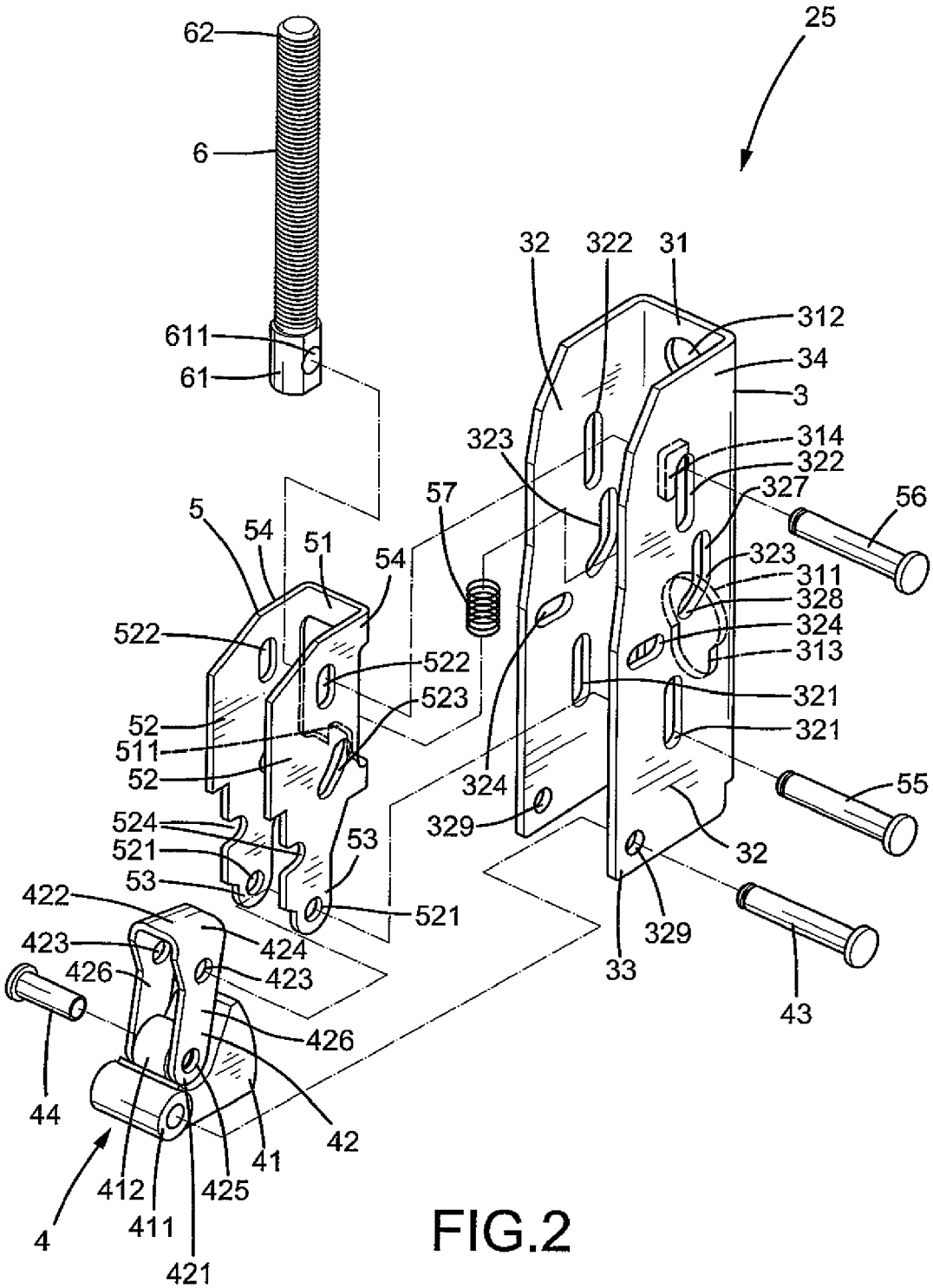
FIG. 2 shows an exploded perspective view of a universal assembly utilized as a bottom latch of the panic device of FIG. 1.
Figure 3:
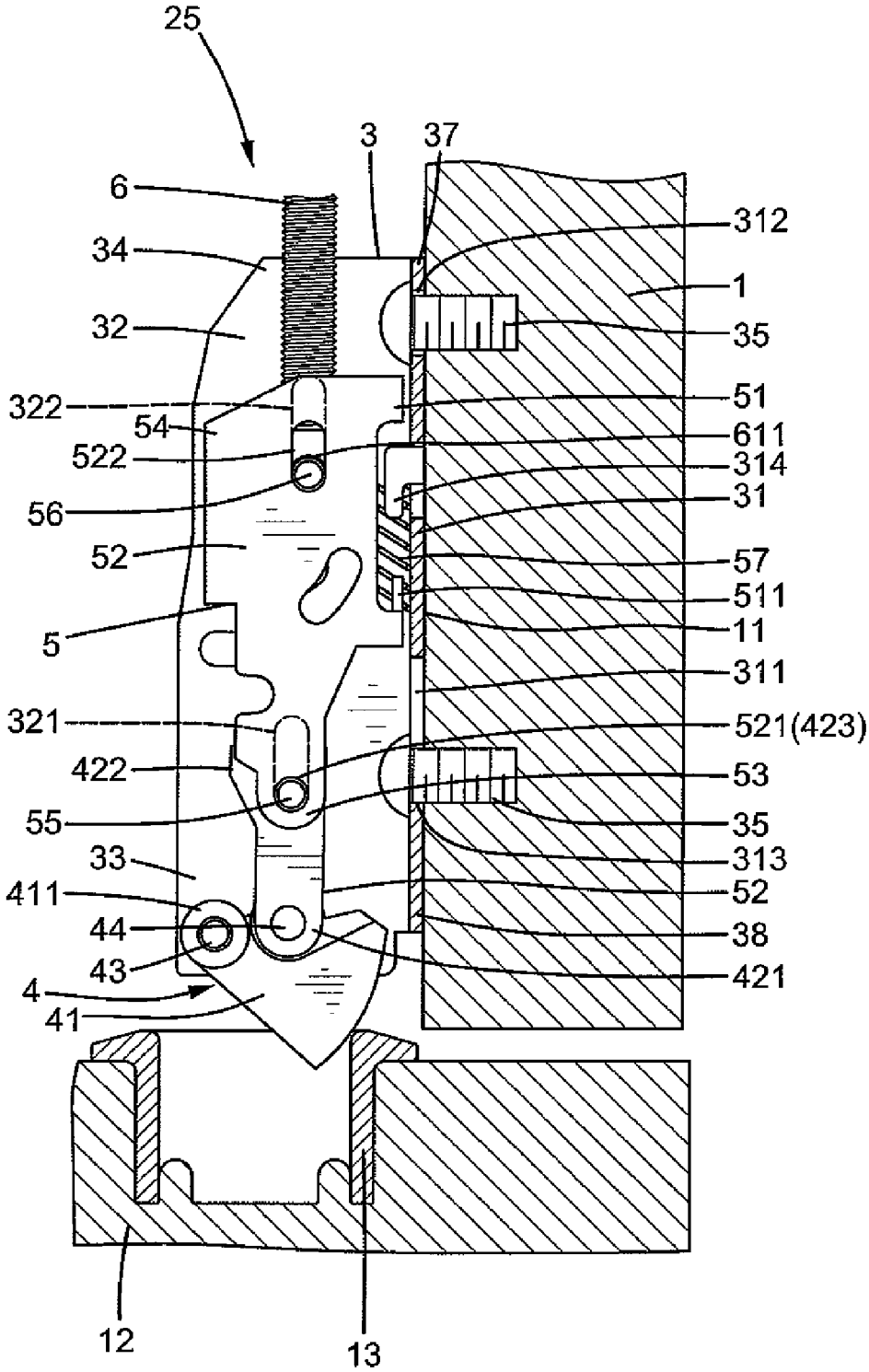
FIG. 3 shows a partial, cross-sectional view of the door of FIG. 1, illustrating the bottom latch of FIG. 1, with a latch bolt of the bottom latch in a latching position.

FIGS. 2 and 3 illustrate a universal assembly according to the preferred teachings of the present invention that can be utilized as the bottom latch 25 or forms a basic part of the top latch 24. According to the preferred form shown, the universal assembly includes a base 3, a latch bolt 4, a follower plate 5, and a linking rod 6. The base 3 is substantially U-shaped and includes a main section 31 having first and second ends 37 and 38 spaced in a vertical direction and two opposite sides extending between the first and second ends 37 and 38. The main section 31 includes a first hole 311 and a second hole 312 spaced in the vertical direction. The first hole 311 has a reduced section 313. A protrusion 314 is formed between the first and second holes 311 and 312. The base 3 further includes two parallel, spaced sidewalls 32 extending perpendicularly from the opposite sides of the base 3 and each having first and second ends 33 and 34. According to the most preferred form shown, the sidewalls 32 include aligned first sliding slots 321 adjacent the first ends 33 and aligned second sliding slots 322 adjacent the second ends 34. Each of the first and second sliding slots 321 and 322 extend in the vertical direction. The sidewalls 32 further include aligned first guiding slots 323 and aligned second guiding slots 324. The first guiding slot 323 on each sidewall 32 is located between the first sliding slot 321 and the second sliding slot 322 of the sidewall 32 in the vertical direction. Furthermore, the first guiding slot 323 includes a vertical section 327 extending in a direction parallel to the first sliding slot 321 and an inclined section 328 at an acute angle with the vertical section 327. The second sliding slot 324 on each sidewall 32 is located between the first guiding slot 323 and the first sliding slot 321 in the vertical direction. The second sliding slot 324 extends in a direction perpendicular to the first sliding slot 321. The sidewalls 32 further include aligned pin holes 329 at the first ends 33 thereof. It can be appreciated that the first and second guiding slots 323 and 324 of the base 3 are not utilized or even can be omitted when utilizing the universal assembly of FIG.

2 as the bottom latch 25. In assembly, a screw 35 (the lower one in FIG. 3) is fixed to the door 1, and the base 3 is hung on the screw 35 at the first hole 311. The base 3 is lifted upward so that the screw 35 is received in the reduced section 313 of the first hole 311. Another screw 35 (the upper one in FIG. 3) is then extended through the second hole 312 into the door 1. The base 3 is, thus, fixedly mounted to the door 1.

Figure 4:
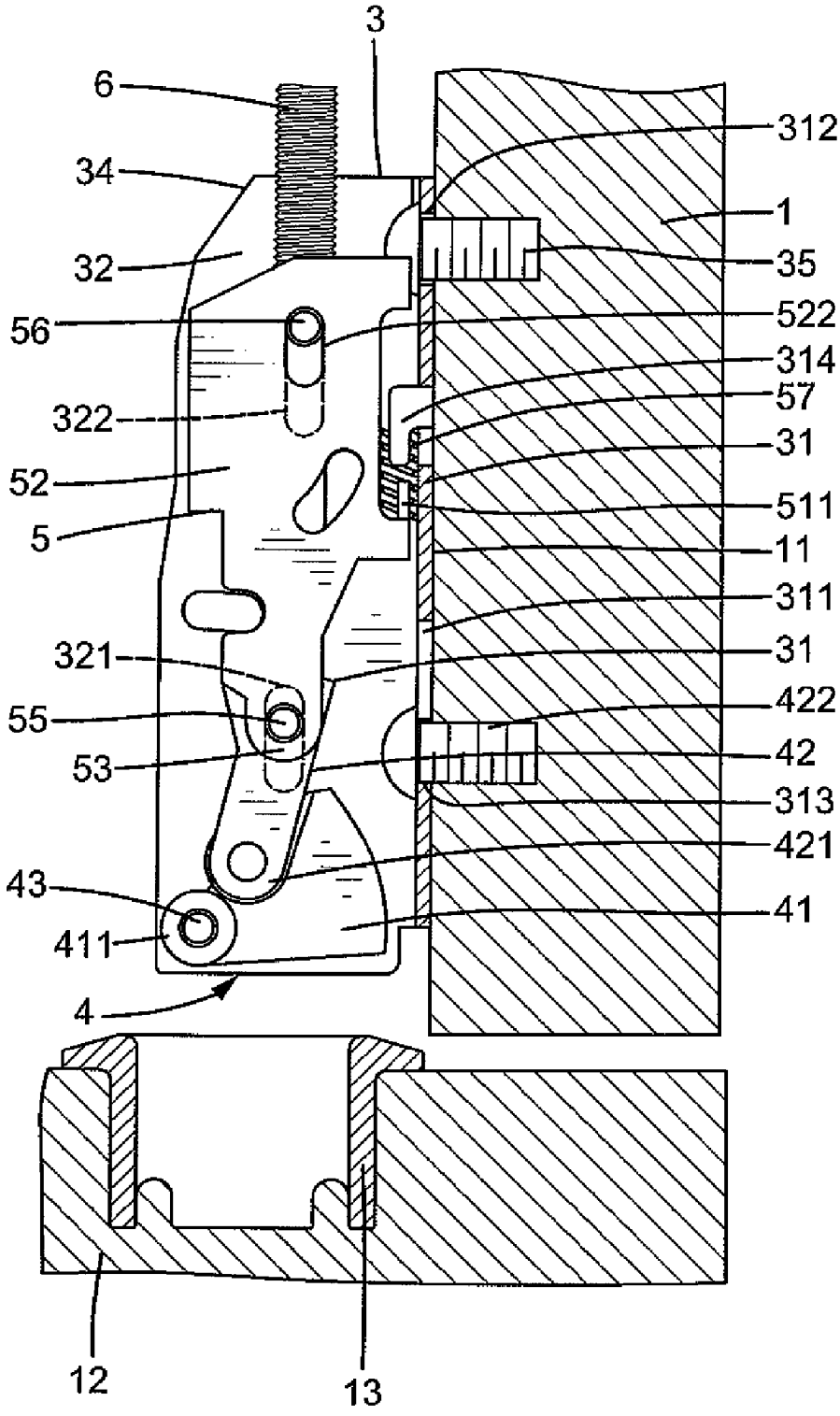
FIG. 4 shows a partial, cross-sectional view of the door of FIG. 1, illustrating the bottom latch of FIG. 1, with the latch bolt of the bottom latch in an unlatching position.

According to the preferred form shown, the latch bolt 4 is mounted between the sidewalls 32 of the base 3 and includes a latch 41 and a link 42. The latch 41 includes a first pivotal portion 411 on an end thereof and a second pivotal portion 412 between two ends of the latch 41. A pin 43 is extended through the pin holes 329 of the sidewalls 32 of the base 3 and the first pivotal portion 411. Thus, the other end of the latch 41 is pivotable between a latching position (see FIG. 3) outside the base 3 and an unlatching position (see FIG. 4) inside the base 3. The link 42 includes a first end 421 pivotally connected to the second pivotal portion 412 and a second end 422. According to the most preferred form shown, the link 42 is substantially U-shaped and includes an intermediate portion 424 and two parallel, spaced sidewalls 426 extending from opposite sides of the intermediate portions 424. The sidewalls 426 include aligned holes 425 in first ends thereof and aligned holes 423 in second ends thereof. A pin 44 is extended through the holes 425 of the link 42 and the second pivotal portion 412, allowing the second end 422 of the link 42 to pivot about a pivot axis defined by the pin 44 that is parallel to the pin 43. A pin 55 is extended through the first sliding slots 321 of the base 3 and the holes 423 of the link 42, allowing the link 42 to move in the vertical direction when the pin 55 slides along the first sliding slots 321.

According to the preferred form shown, the follower plate 5 is mounted between the sidewalls 32 of the base 3. The follower plate 5 is substantially U-shaped and includes an intermediate portion 51 and two parallel, spaced sidewalls 52 extending perpendicularly from opposite sides of the intermediate portion 51. A tab or projection 511 is formed on the intermediate portion 51. A spring 57 is attached between the projection 511 of the follower plate 5 and the protrusion 314 of the base 3 to bias the follower plate 5.

The latch bolt 4 is movably received between the sidewalls 52 of the follower plate 5. The sidewalls 52 include aligned holes 521 in first ends 53 thereof and aligned slots 522 in second ends 54 thereof. Each slot 522 extends in the vertical direction. Each sidewall 52 further includes an engaging notch 524 adjacent the first end 53 thereof. Each sidewall 52 further includes an inclined slot 523 between the hole 521 and the slot 522 and at an acute angle with the extending direction of the slot 522. The pin 55 is parallel to the pins 43 and 44 and extended through the first sliding slots 321 of the base 3, the holes 521 of the follower plate 5, and the holes 423 of the link 42. Thus, an end of the follower plate 5 is pivotably connected to the second end 422 of the link 42. It can be appreciated that the inclined slots 523 and the engaging notches 524 of the follower plate 5 are not utilized or even can be omitted when utilizing the universal assembly of FIG. 2 as the bottom latch 25.

According to the preferred form shown, the linking rod 6 is in the form of a screw rod and includes a first end 61 without threading and a second end 62. The first end 61 has a transverse hole 611 perpendicular to a longitudinal axis of the linking rod 6. The second end 62 of the linking rod 6 is connected to the lower end 233 of the lower vertical rod 232 to move therewith. It can be appreciated that the second end 62 of the linking rod 6 can be integrally formed with the lower end 233 of the lower vertical rod 232. A pin 56 parallel to the pins 43, 44, and 55 is extended through the second sliding slots 322 of the base 3, the slots 522 of the follower plate 5, and the transverse hole 611 of the first end 61 of the linking rod 6. Thus, the follower plate 5 can be moved in the vertical direction together with the linking rod 6 to move the latch 41 between the unlatching position and the latching position.

The bottom latch 25 utilizing the general assembly of FIG. 2 is shown in FIGS. 1 and 3. When the latch 41 is in a latching position outside the base 3 (FIG. 3), the latch 41 is stopped by a strike 13 on the ground 12. The door 1 is, thus, locked. When the touch bar 22 is pressed, the lower vertical rod 232 and the linking rod 6 are moved upward. After the pin 56 reaches upper ends of the slots 522, the follower plate 5 moves upward together with the linking rod 6, which in turn, causes upward pivotal movement of the link 42 about a pivot axis of the pin 43 and compresses the spring 57. The latch 41 is moved to the unlatching position (FIG. 4) in the base 3 and disengaged from the strike 13. As mentioned above, the first and second guiding slots 323 and 324 of the base 3 as well as the inclined slots 523 and the engaging notches 524 of the follower plate 5 are not utilized or can be omitted when utilizing the universal assembly of FIG. 2 as the bottom latch 25. When the linking rod 6 is released due to release of the touch bar 22, the spring 57 moves the follower plate 5 away from the base 3 and, thus, returns the latch 41 to the latching position. It can be appreciated that idle movement of the pin 56 in the slots 522 of the follower plate 5 provides a burglar-proof effect. Particularly, when the panic device 2 is picked to move the vertical rod 6 in the vertical direction, the small vertical displacement of the vertical rod 6 will not cause unlatching of the latch 42.

The base 3 of the bottom latch 25 shown in FIGS. 1 and 3 is of surfaced type. However, the base 3 of the bottom latch 25 can be mounted in an interior of the door 1 such that the whole bottom latch 25 becomes a concealed-type bottom latch.

Figure 5:
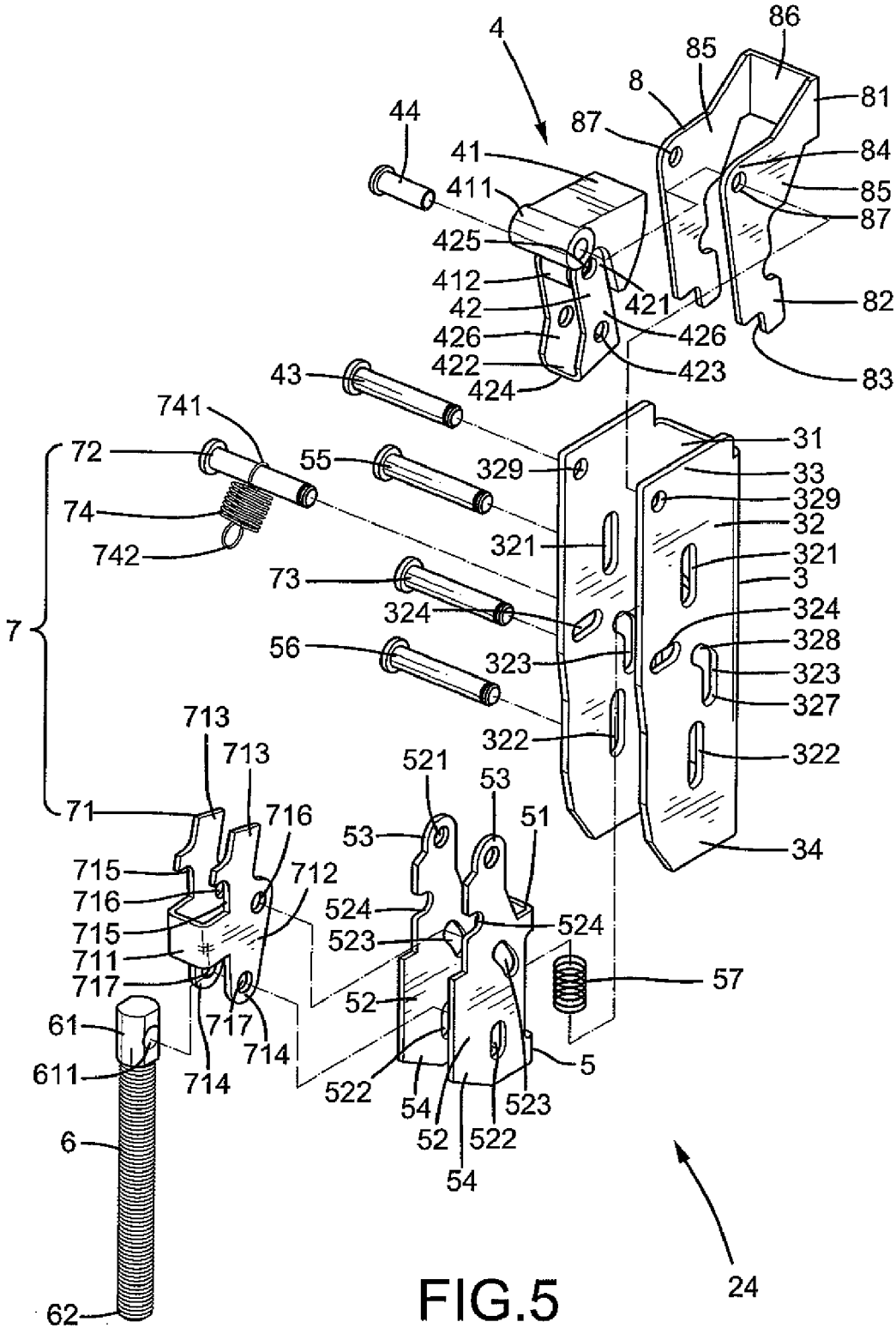
FIG. 5 shows an exploded perspective view of a surfaced-type top latch of the panic device of FIG. 1.

After adding some parts, the bottom latch 25 can form a surfaced-type top latch 24 for the panic device 2. According to the preferred form shown in FIG. 5, the surfaced-type top latch 24 includes the base 3, the latch bolt 4, the follower plate 5, and the linking rod 6 that form the bottom latch 25 but arranged in an upside-down manner, wherein same reference numerals are utilized to designate same elements. Detailed description of these elements are omitted to avoid redundancy. However, it is noted that the second end 62 of the linking rod 6 of the top latch 24 is connected to the upper end 234 of the upper vertical rod 231. The top latch 24 further includes a locking device 7 and a guard plate 8. The locking device 7 is mounted on the base 3 to lock the latch 41 in the latching position or the unlatching position. Due to provision of the locking device 7, the top latch 24 and the bottom latch 25 can be unlatched only when the touch bar 22 is pressed. A deadlocking effect is, thus, provided.

Figure 6:
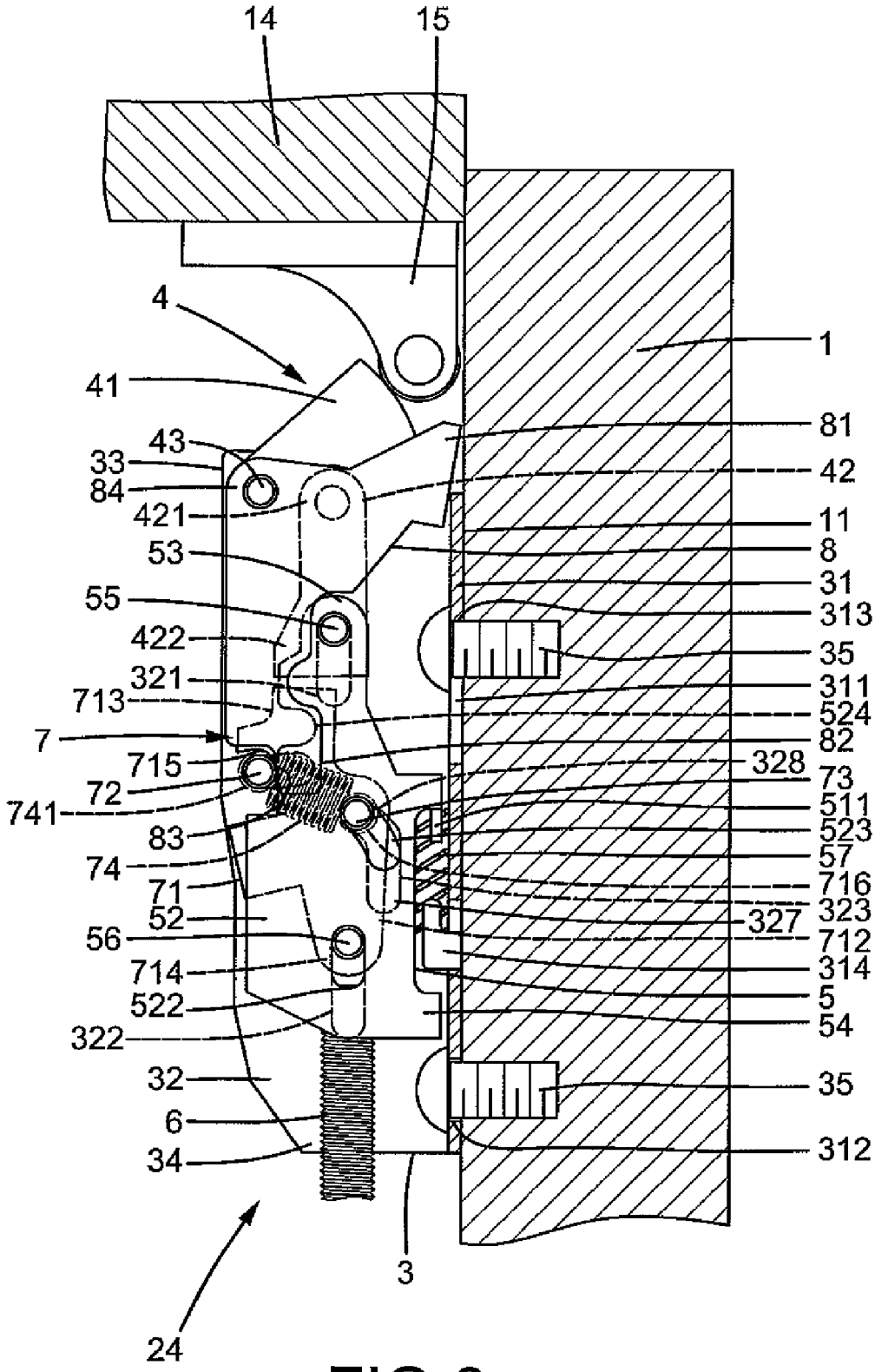
FIG. 6 shows a partial, cross-sectional view of the door of FIG. 1, illustrating the top latch of FIG. 1, with a latch bolt of the top latch in a latching position.
Figure 7:
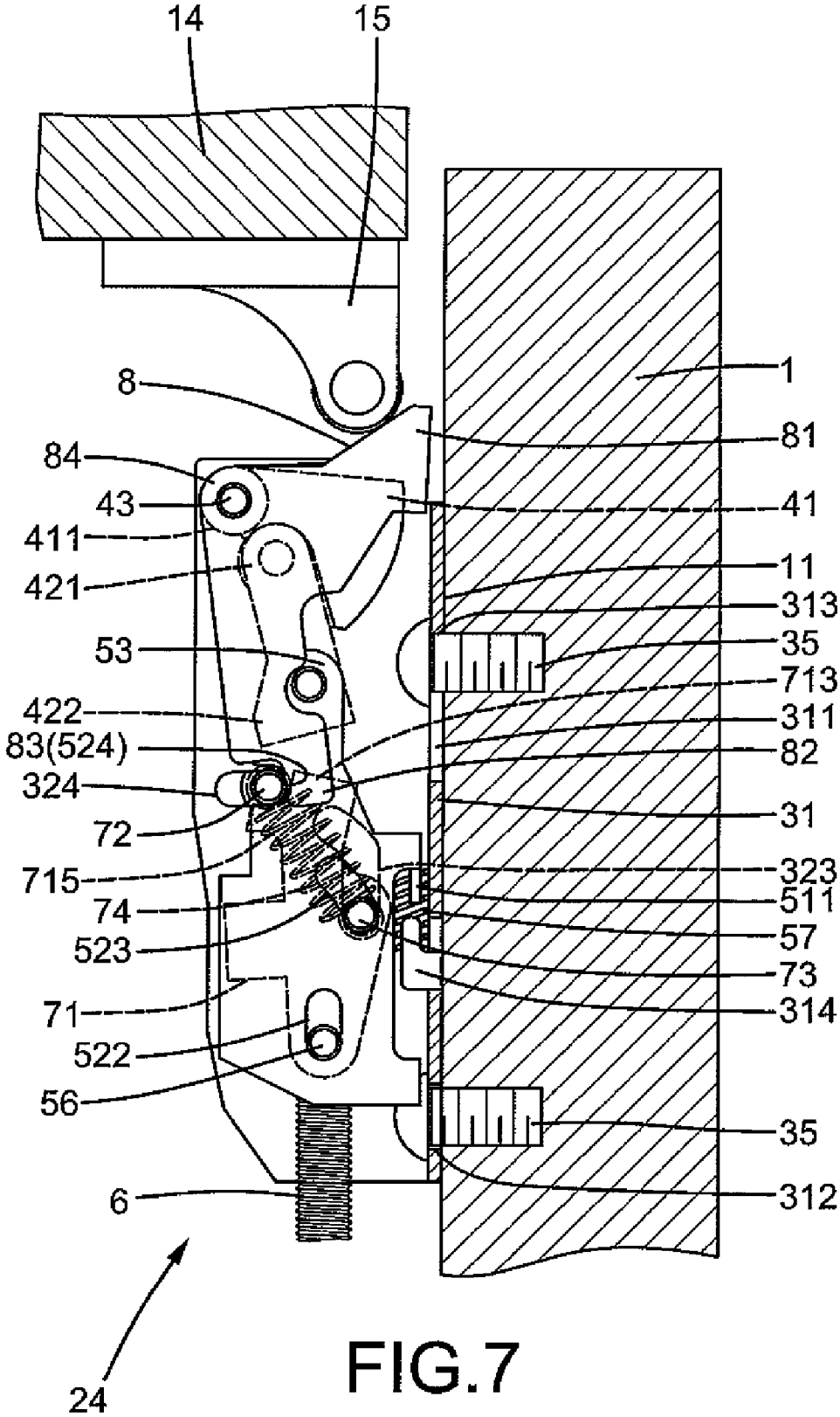
FIG. 7 shows a partial, cross-sectional view of the door of FIG. 1, illustrating the top latch of FIG. 1, with the latch bolt of the top latch in an unlatching position.

According to the preferred form shown, the locking device 7 includes a safety plate 71, a positioning pin 72, and a spring 74 in the preferred form shown as a tension spring. The safety plate 71 includes two parallel, spaced sidewalls 712 interconnected by a substantially U-shaped interconnecting section 711 and movably received between the sidewalls 52 of the follower plate 5. Each sidewall 712 includes first and second ends 713 and 714. Aligned holes 717 are defined in the second ends 714 of the sidewalls 712. The sidewalls 712 further include aligned holes 716 between the first and second ends 713 and 714 thereof. The pin 56 is extended through the second sliding slots 322 of the base 3, the slots 522 of the follower plate 5, the holes 717 of the safety plate 71, and the transverse hole 611 of the first end 61 of the linking rod 6. Thus, the follower plate 5 can be moved in the vertical direction together with the linking rod 6 to move the latch 41 between the unlatching position and the latching position. Furthermore, the safety plate 71 can move in the vertical direction together with the linking rod 61. A pin 73 is extended through the first guiding slots 323 of the base 3, the inclined slots 523 of the follower plate 5, and the holes 716 of the safety plate 71 such that the safety plate 71 is pivotable about a pivot axis defined by the pin 56 while the pin 73 is moving between two ends of the inclined slots 523 and along the vertical sections 327 and the inclined sections 328 of the first guiding slots 323. Each sidewall 712 of the safety plate 71 further includes an engaging notch 715. The positioning pin 72 is extended through the second guiding slots 324 of the base 3 and movable between two ends of the second guiding slots 324. The positioning pin 72 can be engaged with the engaging notches 715 of the safety plate 71 or the engaging notches 524 of the follower plate 5. With reference to FIG. 6, when the latch 41 of the latch bolt 4 is in the latching position, the positioning pin 72 is engaged with the engaging notches 715 of the safety plate 71 so that the latch 41 can not be moved to the unlatching position. With reference to FIG. 7, when the latch 41 is in the unlatching position, the positioning pin 72 is engaged with the engaging notches 524 of the follower plate 5 so that the latch 41 does not extend beyond the base 3 to interrupt closing of the door 1. The spring 74 includes a first end 741 attached to the positioning pin 72 and a second end 742 attached to the pin 73 to bias the safety plate 71 toward the positioning pin 72. Thus, the follower plate 5 and the latch bolt 4 are biased upward.

According to the preferred form shown, the guard plate 8 is mounted to the first ends 33 of the sidewalls 32 of the base 3. When the door 1 is closed, the latch bolt 4 in the unlatching position is released so that the latch 41 of the latch bolt 4 automatically moves to the latching position. According to the most preferred form shown, the guard plate 8 includes two parallel, spaced sidewalls 85 interconnected by an interconnecting section 86 therebetween. Each sidewall 85 includes first and second ends 81 and 82 and aligned holes 87 between the first and second ends 81 and 82, providing a pivotal portion 84 between the first and second ends 81 and 82 of each sidewall 85. The pin 43 is extended through the pin holes 329 of the base 3, the first pivotal portion 411 of the latch bolt 4, and the holes 87 of the guard plate 8, allowing the first ends 81 of the sidewalls 85 and the interconnecting section 86 interconnected between the first ends 81 to pivot outside the base 3. The second end 82 of each sidewall 85 has a notch 83 that can be in contact with and movable together with the positioning pin 72 of the locking device 7.

When the latch 41 of the latch bolt 4 is in the latching position outside the base 3 (FIG. 6), the latch 41 is stopped by a strike 15 on an upper beam 14 of a door frame. The door 1 is, thus, locked. It is noted that the positioning pin 72 is engaged with the engaging notches 715 of the safety plate 71 to lock the latch 41 in the latching position. When the touch bar 22 is pressed, the latch 41 of the latch bolt 4 is moved to the unlatching position in the base 3 (FIG. 7). The linking rod 6 is moved downward by the upper vertical rod 231 (FIG. 1), and the positioning pin 72 is moved to a position engaged in the engaging notches 524 of the follower plate 5 to lock the latch 41 in the unlatching position. When the touch bar 22 is released, the linking rod PM 6 moved downward, and the spring 57 moves the follower plate 5 away from the base 13 to return the latch 41 to the latching position (FIG. 6).

Figure 8:
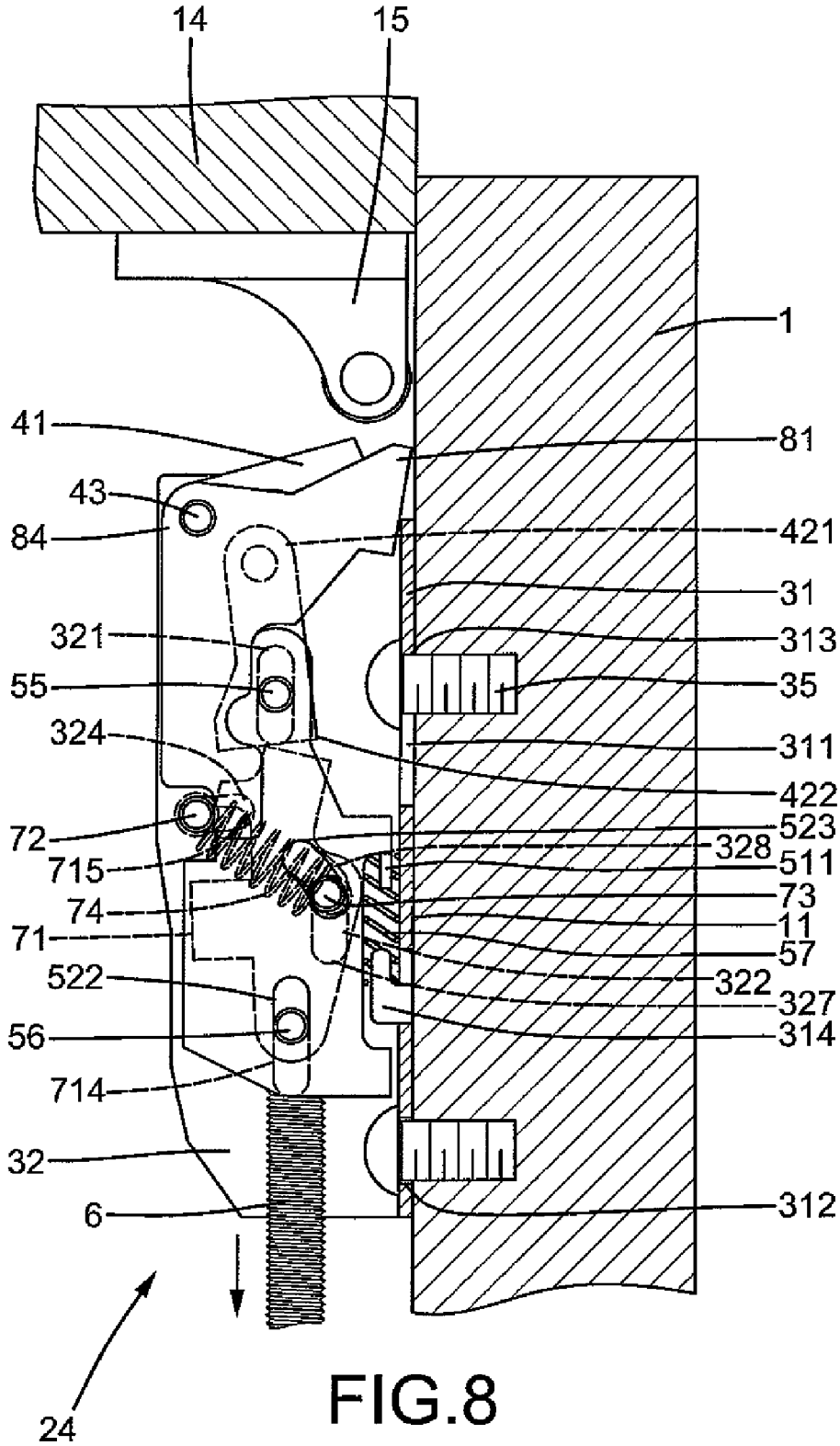
FIG. 8 shows a partial, cross-sectional view of the door of FIG. 1, illustrating the top latch of FIG. 1, with a guard plate disengaged from a positioning pin.

With reference to FIG. 8, when the linking rod 6 is moving downward, the first ends 713 of the sidewalls 712 of the safety plate 71 pivot downward about the pivot axis defined by the pin 56 while the positioning pin 72 is moving inward along the second guiding slots 524 of the follower plate 5. Thus, the safety plate 71 is unlocked and moves downward while the pin 56 is moving downward in the slots 522 of the follower plate 5. After the pin 56 reaches the lower ends of the slots 522 of the follower plate 5, the follower plate 5, the safety plate 71, and the latch bolt 4 are moved downward. Thus, the latch 41 moves from the latching position (FIG. 6) to the unlatching position (FIG. 7). At the same time, the positioning pin 72 is moved to the inner ends of the second guiding slots 324 of the base 3 and engages with the engaging notches 524 of the follower plate 5 while the spring 74 is in tension. The latch 41 is, thus, retained in the unlatching position.

FIG. 7 also shows that the strike 15 presses against the interconnecting section 86 between the first ends 81 of the sidewalls 85 of the guard plate 8 when closing the door 1. FIG. 8 also shows that the guard plate 8 pushes the positioning pin 72 and, thus, disengages the positioning pin 72 from the engaging notches 524 of the follower plate 5. Specifically, when closing the door 1, the interconnecting section 86 of the sidewalls 85 of the guard plate 8 impinges the strike 15 so that the second ends 82 of the sidewalls 85 of the guard plate 8 pivot toward the positioning pin 72, which in turn, disengages the positioning pin 72 from the engaging notches 524 of the follower plate 5 to release the latch bolt 4. The pin 73 is moved upward in the inclined slots 523 of the follower plate 5 under the action of the spring 74 so that the safety plate 71 is moved upward. At the same time, the latch 41 is moved to the latching position outside the base 3 under the action of the spring 74. Furthermore, under the action of the spring 74 and guiding of the inclined slots 523 of the follower plate 5 and the first guiding slots 323 of the base 3, the safety plate 71 returns to a position shown in FIG. 6 and is retained in place, as the pin 72 is engaged with the engaging notches 715 of the safety plate 71.

Figure 9:
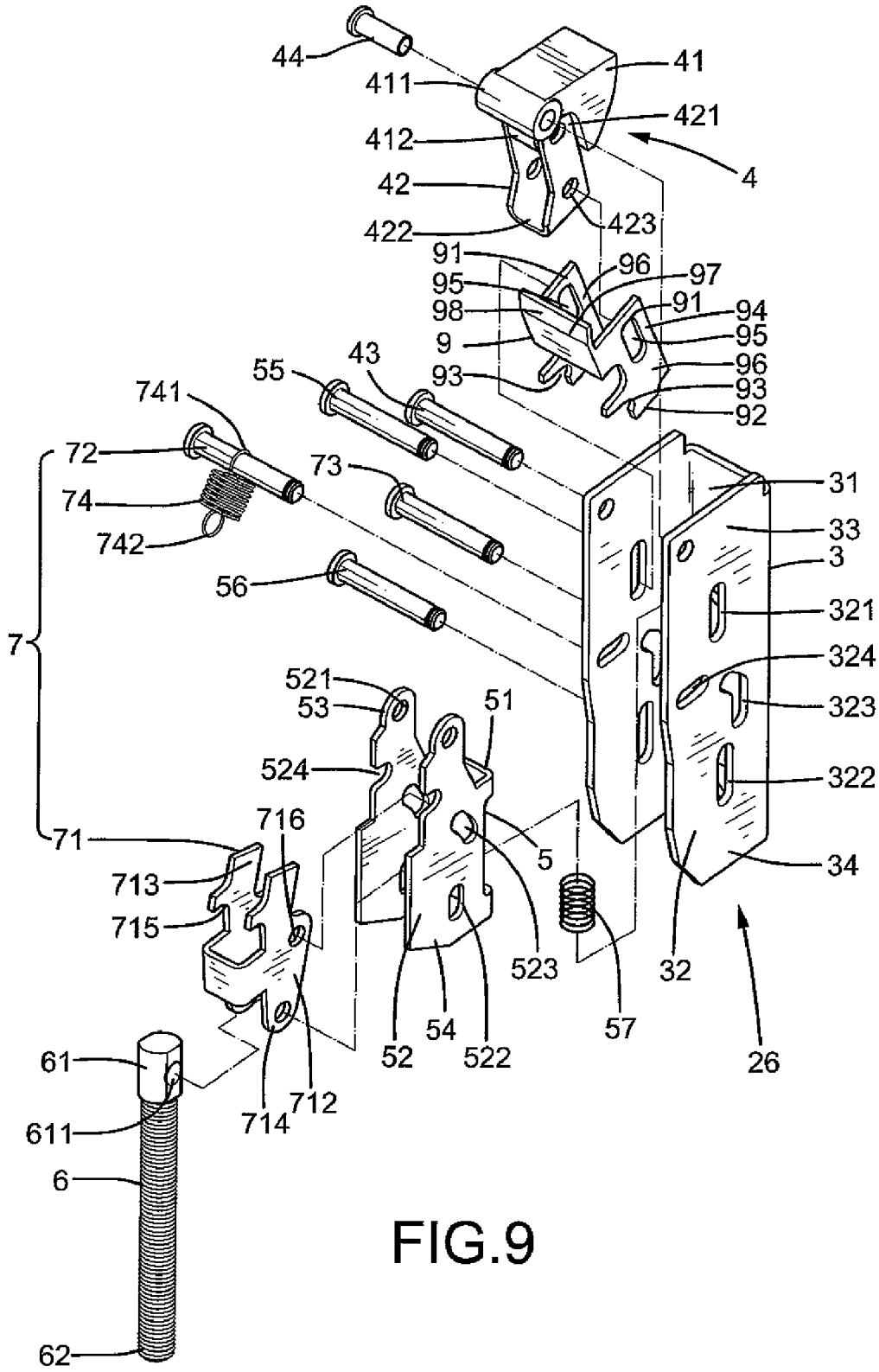
FIG. 9 shows an exploded perspective view of a concealed-type top latch according to the preferred teachings of the present invention.

As mentioned above, the top latch 24 shown in FIG. 5 is of surfaced type. By replacing the guard plate 8 with another guard plate 9, the top latch 24 can be converted into a concealed-type top latch 26 shown in FIG. 9. According to the preferred form shown in FIG. 9, the surfaced-type top latch 26 includes the base 3, the latch bolt 4, the follower plate 5, the linking rod 6, and the locking device 7, all of which are identical to those of the surfaced type top latch 24, wherein same reference numerals are utilized to designate same elements. Detailed description of these elements are omitted to avoid redundancy, although the elements of the concealed-type top latch 26 are mounted inside the door 1. However, it is noted that the upper beam 14 of the door frame includes a compartment 16 for receiving the latch 41 of the latch bolt 4 in the latching position for locking purposes. The concealed-type top latch 26 further includes a guard plate 9.

According to the preferred form shown, the guard plate 9 is mounted to the first ends 33 of the sidewalls 32 of the base 3. The guard plate 9 includes two parallel, spaced sidewalls 96 interconnected by an interconnecting section 97 therebetween. The sidewalls 96 include aligned slots 95 in first ends 91 thereof and aligned notches 93 in second ends 92 thereof. The first end 91 of each sidewall 96 having the slot 95 also forms a pivotal portion 94. The pin 55 is extended through the first sliding slots 321 of the base 3, the holes 423 of the latch bolt 4, and the slots 95 of the guard plate 9, allowing the guard plate 9 to pivot about the pivot axis defined by the pin 55. The notches 93 can be in contact with and movable together with the positioning pin 72 of the locking device 7. A strike 15 is mounted to the upper beam 14 and includes an extension 151 extending through a slot 111 in the door 1 into an interior of the door 1 where the concealed-type top latch 26 is mounted.

Figure 10:
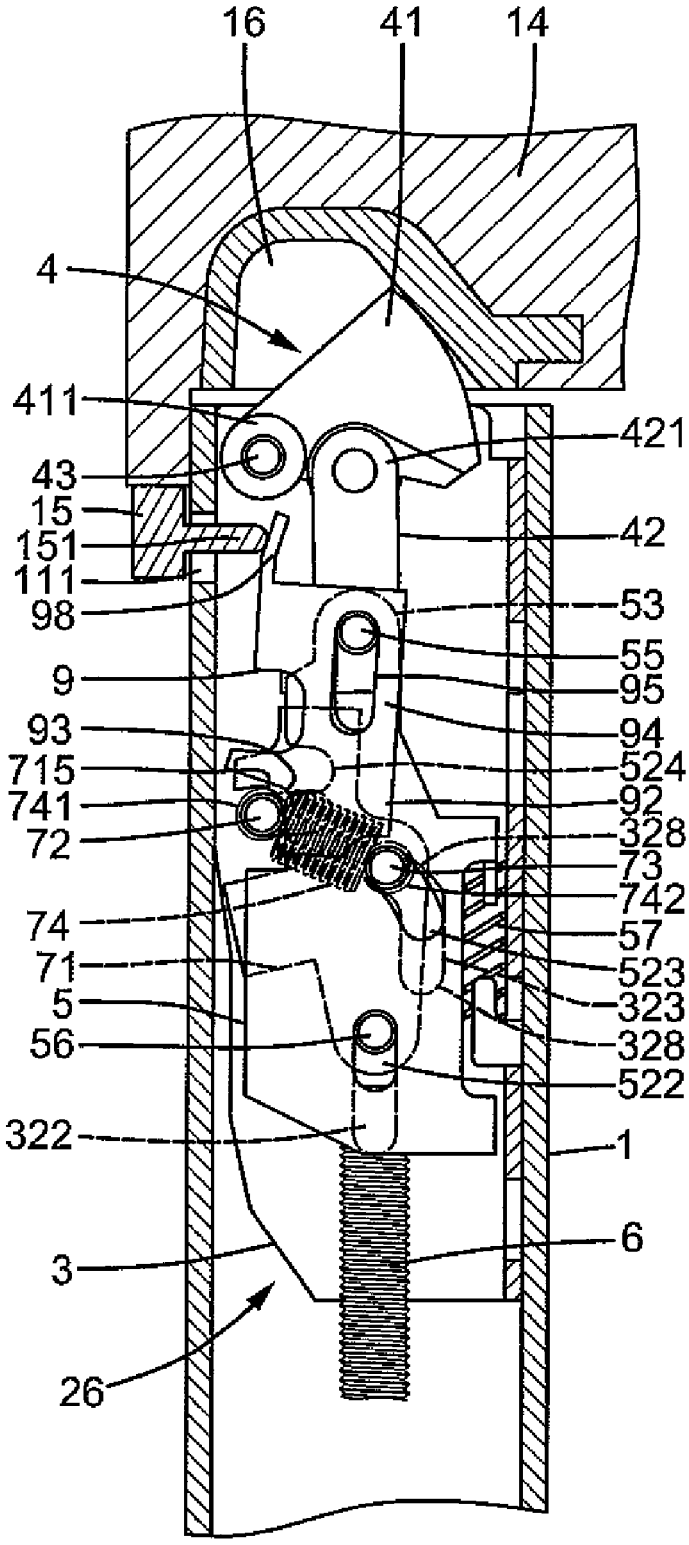
FIG. 10 shows a partial, cross-sectional view of a door utilizing the concealed-type top latch of FIG. 9, with a latch bolt of the top latch in a latching position.

When the latch 41 of the latch bolt 4 is in the latching position outside the base 3 (FIG. 10), the latch 41 is received in the compartment 16 of the upper beam 14 of the door frame. The door 1 is, thus, locked. It is noted that the positioning pin 72 is engaged with the engaging notches 715 of the safety plate 71 to lock the latch 41 in the latching position. When the touch bar 22 is pressed, the latch 41 of the latch bolt 4 is moved to the unlatching position in the base 3. The linking rod 6 is moved downward by the upper vertical rod 231 (FIG. 1), and the positioning pin 72 is moved to a position engaged in the engaging notches 524 of the follower plate 5 to lock the latch 41 in the unlatching position. When the touch bar 22 is released, the linking rod 6 moved downward, and the spring 57 moves the follower plate 5 away from the base 13 to return the latch 41 to the latching position (FIG. 10).

Figure 11:
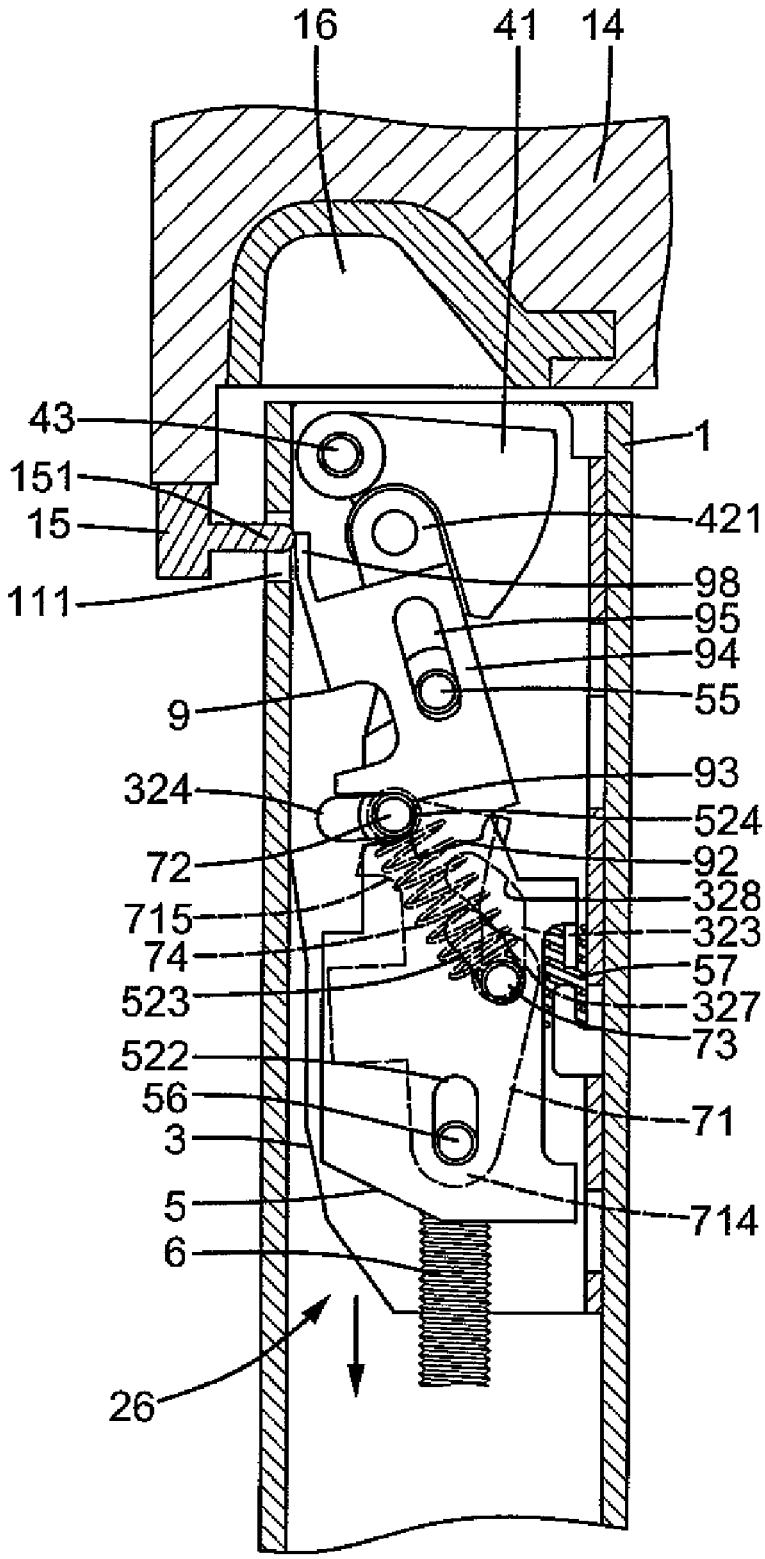
FIG. 11 shows a partial, cross-sectional view of a door utilizing the concealed-type top latch of FIG. 9, with the latch bolt of the top latch in an unlatching position.

With reference to FIG. 11, when the linking rod 6 is moving downward, the first ends 713 of the sidewalls 712 of the safety plate 71 pivot downward about the pivot axis defined by the pin 56 while the positioning pin 72 is moving inward along the second guiding slots 524 of the follower plate 5. Thus, the safety plate 71 is unlocked and moves downward while the pin 56 is moving downward in the slots 522 of the follower plate 5. After the pin 56 reaches the lower ends of the slots 522 of the follower plate 5, the follower plate 5, the safety plate 71, and the latch bolt 4 are moved downward. Thus, the latch 41 moves from the latching position (FIG. 10) to the unlatching position (FIG. 11). At the same time, the positioning pin 72 is moved to the inner ends of the second guiding slots 324 of the base 3 and engages with the engaging notches 524 of the follower plate 5 while the spring 74 is in tension. The latch 41 is, thus, retained in the unlatching position.

When closing the door 1, the end 98 of the guard plate 9 impinges the extension 151 of the strike 15 so that the guard plate 9 pivots toward the positioning pin 72, which in turn, disengages the positioning pin 72 from the engaging notches 524 of the follower plate 5 to release the latch bolt 4. The pin 73 is moved upward in the inclined slots 523 of the follower plate 5 under the action of the spring 74 so that the safety plate 71 is moved upward. At the same time, the latch 41 is moved to the latching position outside the base 3 under the action of the spring 74. Furthermore, under the action of the spring 74 and guiding of the inclined slots 523 of the follower plate 5 and the first guiding slots 323 of the base 3, the safety plate 71 returns to a position shown in FIG. 10 and is retained in place, as the pin 72 is engaged with the engaging notches 715 of the safety plate 71.

Now that the basic teachings of the present invention have been explained, many extensions and variations will be obvious to one having ordinary skill in the art. For example, the base 3, the follower plate 5, the safety plate 7, the guard plates 8 and 9 are not limited to be U-shaped. One of the sidewalls 32, 52, 712, 85, 96 of the base 3, the follower plate 5, the safety plate 7, the guard plates 8 and 9 can be omitted. Furthermore, the intermediate portion 51 of the follower plate 5, the interconnecting section 711 of the safety plate 71, the interconnecting section 86 of the guard plate 8, and the interconnecting section 97 of the guard plate 9 can be omitted. Furthermore, when utilizing the universal assembly shown in FIG. 2 as a bottom latch 24 of a panic device 2, the slots 522 of the follower plate 5 can be circular, and the pin 56 does not have to extend through the second sliding slots 322 of the base 3; i.e., the second sliding slots 322 of the base 3 can be omitted.

As mentioned above, the universal assembly shown in FIG. 2 can be utilized as a bottom latch 24 of a panic device 2. The bottom latch 24 can be a surfaced-type bottom latch if mounted to the side 11 of the door 1 or a concealed-type bottom latch if mounted inside the door 1. After adding some parts into the bottom latch 24, a surfaced-type top latch 25 or a concealed-type top latch 26 of the panic device 2 is provided. The inventory costs are greatly reduced. The top and bottom latches 25 and 24 are simultaneously unlatched by pressing the touch bar 22 through transmission by the upper and lower vertical rods 231 and 232.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A universal latch kit comprising, in combination:

a base adapted to be mounted to a door, with the base being substantially U-shaped and including a main section and two sidewalls interconnected by the main section, with the two sidewalls of the base including aligned first sliding slots extending in the vertical direction, with the two sidewalls of the base further including aligned second sliding slots extending in the vertical direction and above the first sliding slots, with the two sidewalls of the base further including aligned first guiding slots each between one of the first sliding slots and one of the second sliding slots, with the two sidewalls of the base further including aligned second guiding slots each between one of the first sliding slots and one of the first guiding slots in the vertical direction;

a latch bolt including a latch having a first end pivotably connected to the base and a second end, with the latch including a first pivotal portion on the first end thereof and a second pivotal portion between the first and second ends thereof, with a first pin extending through the base and the first pivotal portion of the latch and defining a first pivot axis about which the second end of the latch pivots, with the latch bolt further including a link having a first end pivotably connected to the latch by a second pin, with the second pin extending through the first end of the link and the second pivotal portion of the latch and defining a second pivot axis parallel to the first pivot axis, with the link further including a second end pivotably connected to the base, with the second end of the latch being pivotable between a latching position outside the base and an unlatching position inside the base;

a follower plate movably received in the base in a vertical direction, with the follower plate including a first end and a second end, with the first end of the follower plate being pivotably connected to the second end of the link, allowing pivotal movement of the follower plate and the link relative to the base and allowing relative pivotal movement between the follower plate and the link, with a third pin slideably extending through the first sliding slots in the vertical direction, with the third pin further extending through the first end of the follower plate and the second end of the link, allowing pivotal movement of the follower plate and the link relative to the base and allowing relative pivotal movement between the follower plate and the link, with the follower plate being substantially U-shaped and including two sidewalls and an intermediate section interconnecting the two sidewalls of the follower plate, with the two sidewalls of the follower plate including aligned slots extending in the vertical direction, with the two sidewalls of the follower plate further including aligned inclined slots each between the third pin and the slot of one of the two sidewalls of the follower plate;

a linking rod including a first end coupled with the second end of the follower plate to move therewith, with the linking rod further including a second end adapted to be connected to a vertical rod of a panic device mounted to the door to move therewith, with a fourth pin extending through the second sliding slots of the base, the follower plate, and the first end of the linking rod, allowing joint vertical movement of the linking rod, the follower plate, and the fourth pin, with the fourth pin slideably extending through the slots of the two sidewalls of the follower plate, with the third pin extending through the two sidewalls of the follower plate and below the fourth pin;

wherein when the linking rod moves in the vertical direction, the follower plate moves together with the linking rod in the vertical direction to pivot the latch between the latching position and the unlatching position;

a locking device including:

a positioning pin slideably extending through the second guiding slots of the base;

a safety plate, with the fourth pin extending through the safety plate to pivotably connect the safety plate to the first end of the linking rod while allowing joint movement of the linking rod and the safety plate in the vertical direction;

a fifth pin extending through the first guiding slots of the base, the inclined slots of the follower plate, and the safety plate, with the safety plate pivoting about a pivot axis defined by the fourth pin while the fifth pin is moving in the inclined slots of the follower plate and the first guiding slots of the base; and a first spring attached between the positioning pin and the safety plate for biasing the safety plate toward the positioning pin, wherein when the second end of the latch is in the latching position, the positioning pin is engaged with the safety plate to retain the latch in place, wherein when the second end of the latch is in the unlatching position, the positioning pin is engaged with the follower plate to retain the latch in place;

a first guard plate including two sidewalls interconnected by an interconnecting piece; and a second guard plate including two sidewalls interconnected by an interconnecting section, with the two sidewalls of the second guard plate including aligned slots, with each of the first and second guard plates selectively and pivotably mounted to the base between the two sidewalls of the base and including a first end and a second end, with the first end of each of the first and second guard plates being adapted to be pressed against by a strike mounted to a door frame of the door when the door is being closed, with the second end of each of the first and second guard plates coming in contact with and urging the positioning pin to disengage from the follower plate to release the latch when the first end of the first or second guard plate is pressed against by the strike, with the second end of the latch moving to the latching position by the first spring, wherein a concealed or surfaced bottom latch is formed when the base, the latch bolt, the follower plate, and the linking rod are assembled, wherein a surfaced top latch is formed when the base, the latch bolt, the follower plate, the linking rod, the locking device, and the first guard plate are assembled with the first pin extending through the two sidewalls of the first guard plate to pivotably connect the first guard plate to the base and the first pivotal portion of the latch, and wherein a concealed top latch is formed when the base, the latch bolt, the follower plate, the linking rod, the locking device, and the second guard are assembled with the third pin extending through the first sliding slots of the base, the second end of the link, and the aligned slots of the second guard plate.

2. The universal latch kit as claimed in claim 1, with the follower plate and the latch bolt being movably received between the two sidewalls of the base, with the first pin extending through the two sidewalls of the base, with the third pin being parallel to the first and second pins, and with the third pin moving in the first sliding slots in the vertical direction when the linking rod moves in the vertical direction to move the second end of the latch between the latching position and the unlatching position.

3. The universal latch kit as claimed in claim 2, with the second end of the link received between the two sidewalls of the follower plate.

4. The universal latch kit as claimed in claim 3, further comprising, in combination: a second spring attached between the intermediate section of the follower plate and the main section of the base, with the second spring biasing the second end of the latch to the latching position.

5. The universal latch kit as claimed in claim 4, with each of the first guiding slots including a vertical section extending in the vertical direction and an inclined section at an acute angle with the vertical section, with each of the second guiding slots extending in a horizontal direction perpendicular to the vertical direction, with the follower plate further including aligned first engaging notches, with the safety plate (71) including a second engaging notch (715), with the fifth pin being parallel to the fourth pin, wherein when the second end of the latch is in the latching position, the positioning pin is engaged with the second engaging notch of the safety plate to retain the latch in place, and wherein when the second end of the latch is in the unlatching position, the positioning pin is engaged with the first engaging notches of the follower plate to retain the latch in place.

* * * * *